US010377128B2

(12) United States Patent
Holtman et al.

(10) Patent No.: US 10,377,128 B2
(45) Date of Patent: Aug. 13, 2019

(54) METHOD FOR CONTROLLING A WEB IN A PRINTING APPARATUS

(71) Applicant: Océ Holding B.V., Venlo (NL)

(72) Inventors: Lodewijk T. Holtman, Venlo (NL); Maurice J. C. Lemmens, Venlo (NL); Jeroen J. G. Coenen, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 242 days.

(21) Appl. No.: 15/600,232

(22) Filed: May 19, 2017

(65) Prior Publication Data

US 2017/0341367 A1 Nov. 30, 2017

(30) Foreign Application Priority Data

May 27, 2016 (EP) ..... 16171764
Jul. 12, 2016 (EP) ..... 16179009

(51) Int. Cl.
*B41F 23/04* (2006.01)
*B41J 15/16* (2006.01)
(Continued)

(52) U.S. Cl.
CPC ..... *B41F 23/045* (2013.01); *B41J 11/002* (2013.01); *B41J 11/0005* (2013.01); *B41J 11/42* (2013.01);
(Continued)

(58) Field of Classification Search
CPC ..... B41F 13/02; B41F 23/045; B41J 11/002; B41J 11/005; B41J 11/42; B41J 15/04;
(Continued)

(56) References Cited

U.S. PATENT DOCUMENTS 5,351,071 A 9/1994 Matsuda et al.
2004/0094892 A1* 5/2004 Kuramoto ..... B65H 9/06 271/227

(Continued)

OTHER PUBLICATIONS

European Search Report for EP 16 17 9009, dated Jan. 20, 2017.

*Primary Examiner* — Leslie J Evanisko
*Assistant Examiner* — Marissa Ferguson-Samreth
(74) *Attorney, Agent, or Firm* — Birch, Stewart, Kolasch & Birch, LLP

(57) ABSTRACT

A method is provided for controlling a web in a printing apparatus The printing apparatus includes a transport assembly for moving the web through a transport path along a printing unit for printing an image onto a print area of the web. The method includes feeding the web from a supply roll through the transport path to the transport assembly; and switching the printing apparatus to a ready-to-print mode, wherein the printing unit does not print an image on the web and the web is maintained ready to be printed on. In a printing mode after the ready-to print mode, the following steps are performed: moving the web through the transport path in a transport direction along the printing unit by the transport assembly; and printing the image onto the print area of the web by the printing unit. The image is printed by applying an image material, which solidifies on the web during the printing step. The ready-to-print mode includes the step of: operating the transport assembly to prevent a deformation of the print area of the web in the transport path, while maintaining the web in the ready-to-print mode. The web is maintained ready to print while preventing a deformation of the print area of the web in the transport path.

19 Claims, 7 Drawing Sheets

(51) Int. Cl.

| | |
|---|---|
| ***B65H 23/188*** | (2006.01) |
| ***B65H 23/192*** | (2006.01) |
| ***B65H 23/32*** | (2006.01) |
| ***B41J 11/00*** | (2006.01) |
| ***B41J 11/42*** | (2006.01) |
| *B41F 13/02* | (2006.01) |

(52) U.S. Cl.
CPC ..... *B41J 15/16* (2013.01); *B41J 15/165* (2013.01); *B65H 23/1888* (2013.01); *B65H 23/192* (2013.01); *B65H 23/32* (2013.01); *B41F 13/02* (2013.01); *B65H 2403/50* (2013.01)

(58) Field of Classification Search
CPC ..... B41J 15/16; B41J 15/165; B65H 23/32; B65H 23/192; B65H 23/1888; B65H 2403/50
See application file for complete search history.

(56) References Cited

U.S. PATENT DOCUMENTS

| | | | | |
|---|---|---|---|---|
| 2006/0022080 | A1* | 2/2006 | Salvador | B21C 47/003 242/419.4 |
| 2007/0151468 | A1* | 7/2007 | Strand | B05C 1/0808 101/6 |
| 2009/0033733 | A1 | 2/2009 | Higashimoto et al. | |
| 2013/0214023 | A1* | 8/2013 | de Jong | B41J 11/42 226/1 |
| 2017/0341437 | A1* | 11/2017 | Perez Munoz | B41J 15/165 |

* cited by examiner

Fig. 1A
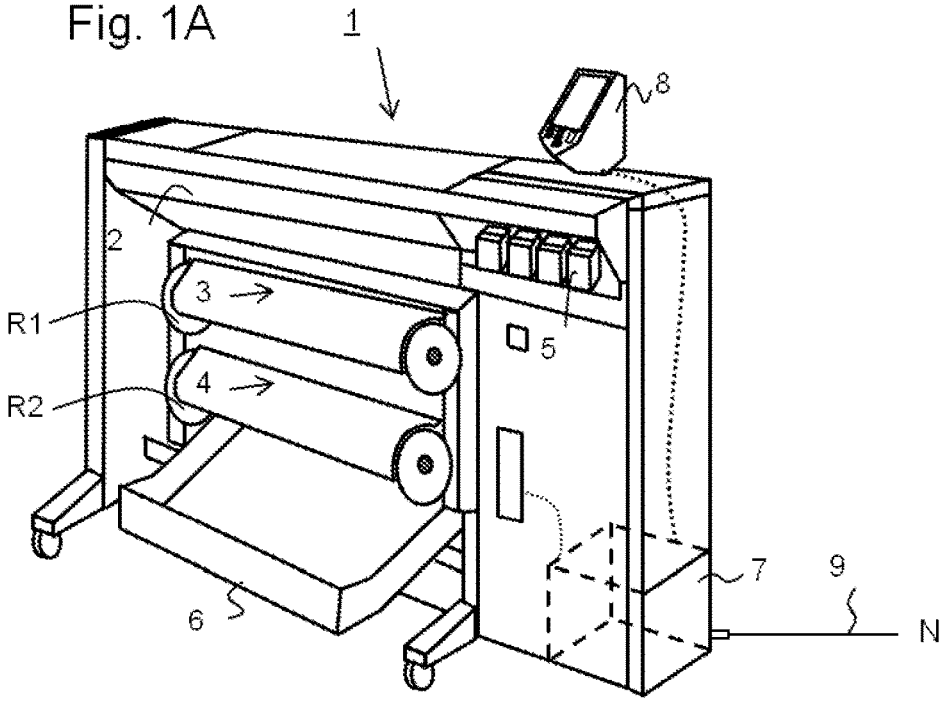
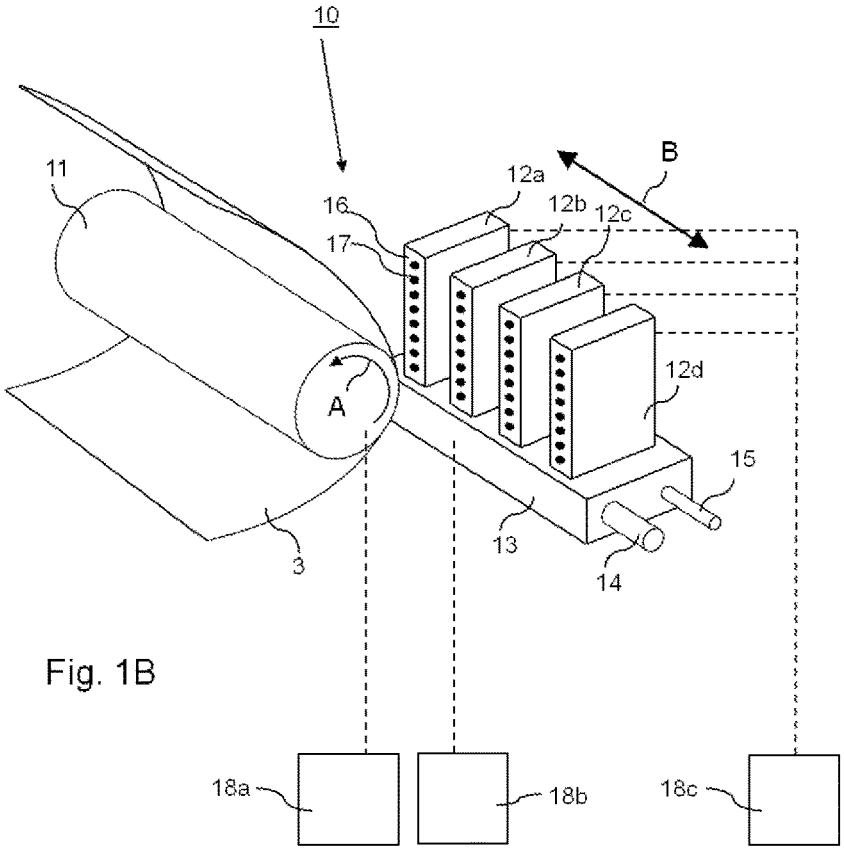
Fig. 1B

METHOD FOR CONTROLLING A WEB IN A PRINTING APPARATUS

FIELD OF THE INVENTION

The present invention pertains to a method and a printing apparatus for controlling a web in a printing apparatus.

BACKGROUND ART

In a known web printing system, an ink is printed on a web media to form an image on a print area of the web. The printing system comprises a supply roller for supplying the web from a roll to a transport pinch, which is configured for moving the web through a transport path in a transport direction along a print unit for printing the ink onto the web to form the image. During printing of the ink onto the web, the ink will solidify on the web.

In a known printing method a leading edge of the web is first fed from the supply roll towards the transport pinch. The transport pinch engages the web to drive the web along the transport path. The transport pinch is arranged near the print unit along the transport path for accurately controlling the web, when it moves along the print unit.

In case the printing system is not printing on the web, the printing system switches to a ready-to-print mode. In the ready-to-print mode, the web is maintained stationary by the transport pinch, such that the web is ready to be printed on directly after the ready-to-print mode, i.e. is enabled to start printing without delay for preparing one or more parts or modules of the printing system for printing.

When the printing system after the ready-to-print mode switches to a printing mode to print a next image onto the web, the web is moved by the transport pinch through the transport path along the print unit and the print unit starts printing the image onto a print area of the web. The print area is an area of the web, on which an image—in this case after the ready-to-print mode in particular a next image—may be printed.

In case the web is maintained stationary by the transport pinch over a longer period of time in the ready-to-print mode, a deformation of the web in the form of pressure marks may occur in the web at the position of the transport pinch. Especially a pressure sensitive web material may be deformed at the transport pinch.

In another example, the printing system further comprises a pre-heat unit for heating the web in a heating zone upstream of the print unit relative to the transport direction. The transport path of the web, which is controlled by the transport pinch, comprises the heating zone.

In case the web is maintained stationary over a longer period of time in the ready-to-print mode, a deformation of the web may occur in the web in the heating zone, due to the heat applied by the pre-heat unit to the stationary web in the heat zone, such as deformation in the form of shrinkage of the web in a width direction due to evaporation of water from the web material.

When the web is deformed during the ready-to-print mode, a printing of the ink on the print area of the web may fixate said deformation of the web as the ink solidifies on the web during the printing step. As a result, a permanent deformation of the web and of the image on the web may occur, which deteriorates the quality of the printed image.

In any of these examples, in a web deformation position along the transport path the web may be deformed in the ready-to-print mode in case the web is exposed to web deformation conditions over a longer period. Said deformation of the web may be relatively persistent in that the deformation will only slowly recover. When the web is exposed to a web deformation condition, such as a pressure in a transport pinch, for only a short period, substantially no deformation of the web will occur or the deformation may substantially instantly recover.

Retracting the web from the transport path back to the supply roll and away from the transport assembly may prevent a deformation of the web, which deformation would occur in response to a longer period in the ready-to-print mode. However, in that case the web is not ready to be printed on, as the web is removed from the transport path and is rewound on the supply roll.

U.S. Pat. No. 5,351,071A describes a thermal printer of the type printing an image on a printing paper wound in the form of a roll. Curling of the printing paper wound in the roll form occurs when the thermal printer is placed in its standby mode over more than a predetermined period of time while the printing paper is held between a platen roller and a thermal head. In order to prevent curling of the printing paper, the printing paper is rewound when the standby mode lasts over more than the predetermined period of time It is an object to provide a method for controlling a web in a printing apparatus, wherein the method prevents deformation of a print area of the web in a ready-to-print mode, in which mode said web is ready to be printed an image onto directly after the ready-to-print mode.

SUMMARY OF THE INVENTION

In a first aspect, the present invention provides a method for controlling a web in a printing apparatus, wherein the printing apparatus comprises a transport assembly for transporting the web over the transport path extending downstream of the supply roll and along a printing unit, said transport path comprising a web deformation zone between the roll supply and the printing unit, the method comprising the steps of:

a) Feeding the web from the supply roll through the transport path to the transport assembly in the transport direction;

b) The transport assembly moving the web through the transport path in the transport direction along the printing unit in a print mode of the printing apparatus;

c) The printing unit in the print mode printing an image onto a print area of the web, wherein the image is printed by applying an image material, which solidifies on the web during the printing step;

d1) Determining a termination of the print mode of the printing apparatus;

d2) Upon determination of the termination of the print mode, switching the printing apparatus to a ready-to-print mode, wherein the printing apparatus is maintained in a state to directly commence printing;

e) In the ready-to-print mode, the transport assembly transporting the print area of the web medium positioned in the deformation zone to a deformation-free zone positioned along the transport path upstream of the supply roll.

During the print mode, the printing system conveys the web in the transport direction and an image is printed on the web by means of the printing unit. The print mode may be temporarily interrupted, such that printing is halted. This may be due to maintenance, supply refills or changes, or an operator's command. The control unit then determines that the print mode has ended and switches the printing system to a ready-to-print, wherein modules of the printing system are maintained in a state to readily commence printing. For example, heating modules may be kept at operating temperatures to avoid start-up times required for bringing said modules up to operational temperatures.

Upon detection of the expiry of the print mode, the control unit switches the printing system to the ready-to-print mode. At specific locations in the printing system, the web is engaged, such that the web is locally deformed. Such locations may be e.g. a transport pinch clenching the medium or a heating module locally drying out a section of the web. When such web deformation zones are upstream of the printing unit, there is a substantial risk that the deformation of the web is made permanent when ink is applied to the deformed web section. Upon drying, the ink "freezes" the deformation into the web. The present invention avoids this by, when the printing system is switched to the ready-to-print mode, transporting an area to be printed outside of the web deformation zone to a deformation-free position elsewhere along the transport path. Thereby, deformation of the print area is avoided. As a result the object of the present invention has been achieved.

As defined herein in the ready-to-print mode the position of the web is controlled by the transport assembly. Furthermore, in the ready-to-print mode the web is ready to be printed on directly after the ready-to-print mode.

After switching from the ready-to-print mode to the printing mode, the web is moved by the transport assembly through the transport path in a transport direction along the printing unit to print the image onto the print area of the web. In this way, substantially no delay is obtained between the ready-to-print mode and the printing mode.

For example, after the ready-to-print mode the web does not have to be moved from a supply roll to the transport assembly before starting the printing mode. In another example, any corrections of orientation of the web with respect to transport path (e.g. a deskewing process of the web) may already be performed by the transport assembly before the ready-to-print mode and the web is maintained in the corrected orientation by the transport assembly during the ready-to-print mode.

The transport assembly for controlling the position of the web along the transport path may comprise a transport pinch, defined by a drive roller for driving the web along the transport path and a pinch roller urged against the drive roller, may comprise a plurality of transport pinches distributed along the transport path, and may comprise a conveyor device having a conveyor body which is configured to support the web, wherein the conveyor body is movable to convey the web along the transport path in the printing system. The conveyer device may comprise a transport belt for supporting the web, at least one deflection roller arranged for tensioning the transport belt and an attraction means for attracting the web onto the transport belt to move the web along the transport path by a movement of the transport belt. The conveyor device may comprise a conveyor drum for supporting the web and comprise an attraction means for attracting the web onto the conveyor drum to move the web along the transport path by a movement of the conveyor drum and may comprise any other transport mechanism for controlling the position of the web along the transport path.

The image material applied in the printing step may be any image material which solidifies on the web during the printing step, thereby at least partially fixing any shape condition of the web in response to the solidification of the image material. In an example, the image material may be a phase change ink, which comprises at least one phase change component which provides a solid phase to the ink, when the phase change ink cools down to the room temperature. In this example, the cooling down step of the phase change ink is part of the printing step of the image. In another example, the image material may be a curable ink, which comprises at least one curable component which solidifies the curable ink when subjected to a curing source. For example, the curable ink may be a radiation curable ink comprising a radiation curable component which solidifies the curable ink when subjected to a curing radiation. In particular, said radiation may be UV radiation and said radiation curable component may react in response to the UV radiation, thereby solidifying the curable ink. In another example, the curable ink may be a heat curable ink comprising a heat curable component which solidifies the curable ink when subjected to a heating condition. In these examples, the curing step of the curable ink is part of the printing step of the image. In another example, the image material may be a liquid ink, which comprises at least one polymeric component and a liquid carrier. The at least one polymeric component is configured to solidify during a drying process of the ink, wherein the liquid carrier is removed from the ink composition. The at least one polymeric component of the liquid ink is selected to at least partially fixing any shape condition of the web in response to the drying process of the ink.

For example, a polymeric component may be selected to be soluble in the liquid carrier of the liquid ink and a polymeric component may be selected to be dispersed in the liquid carrier of the liquid ink.

Said drying process may be performed by applying a heating step on the liquid ink, when the liquid ink is deposited on the web. In this example, the drying step of the liquid ink is part of the printing step of the image.

It is noted that the method according to the present invention may as well be beneficial, even when used in combination with an ink that does not freeze a deformation in the web. For example, a deformation usually includes a local height difference of the web. A local height difference in the web results in a local difference in distance between an inkjet print head of the printing system and the web, which usually results in differences in dot placement and thus in deterioration of image quality, even if the web is able to recover despite the presence of the image material on the web.

In an embodiment, in the printing step c) the image is printed by an inkjet printing unit comprising ejecting droplets of image material to form the image on the web. The droplets of image material are ejected by the inkjet printing unit to form the image in the print area of the web. This inkjet printing process provides an accurate way of forming the image on the web while not physically interacting with the web by the inkjet printing unit. In this way, the web is substantially not subjected by the inkjet printing unit to deformation conditions during the printing step. As a result, a deformation of the web due to the printing step is prevented or at least minimized.

In an embodiment, the method after the printing step c) further comprises the steps of f) retracting the web from the transport path and g) switching the printing apparatus to a sleep mode, wherein the web is not controlled by the transport assembly. The retracting step is moving the leading edge of the web in a backwards direction opposite to the transport direction back to the supply roll, for example by rewinding the web onto the supply roll. By retracting the web from the transport path, the web is no longer controlled or retained by the transport assembly. After retracting the web, the printing apparatus may switch to a sleep mode, wherein the web is not controlled by the transport assembly. The sleep mode is advantageous in case the ready-to-print mode continues over a time longer than a predetermined ready-to-print period. The predetermined ready-to-print period may be selected by an operator and may be selected by a control unit of the printing system. The predetermined time ready-to-print period may be selected in order to reduce an energy consumption of the printing system by switching to the sleep mode.

The predetermined ready-to-print period may be set to 30 minutes. As a result, after 30 minutes the web is retracted from the transport path and the printing apparatus switches to the sleep mode.

In an embodiment, the method further comprises the step of h) operating the transport assembly to deskew at least a part of the web relative to the transport path prior to step d) such that the web during the ready-to-print step e) is in a predetermined orientation with respect to the transport path. In this way, the web is positioned before the ready-to-print mode according to the predetermined orientation with respect to the transport path for positioning the image on the web during the printing step c). In particular, a leading edge of the web may be detected during repositioning of the web relative to the transport path in order that the web is aligned to the transport path. As a result, accurately aligning the image to the web is facilitated by the predetermined orientation of the web in the ready-to-print mode and no time is lost between the ready-to-print mode and the printing mode for deskewing the web.

In an embodiment, the transport assembly comprises a transport pinch comprising a drive roller for driving the web along the transport path and a pressure roller configured for urging against the drive roller in a pressure zone during the moving step b). The transport pinch may accurately control the position of the web along the transport path and may control the movement of the web of step b) to control the position of the web during the printing step c). In an example, the transport pinch may be operated to step wise move the web along the printing unit during the print step c). The transport pinch may be arranged adjacent to the printing unit along the transport path. In this way, the transport pinch accurately controls the position of the web at the printing unit such as during the printing step c).

In an embodiment, the printing apparatus further comprises a pre heat unit configured for heating the web in a heating zone during the ready-to-print step e) and during the printing step c); the transport path comprising the heating zone. The pre heat unit is configured for heating the web in the heating zone. The pre heat unit and the heating zone are arranged upstream of the printing unit relative to the transport direction. The pre heat unit may heat the web in the heating zone such that the web is heated to a predetermined temperature above the room temperature. The heating step of the web may be provided to bring the web to the predetermined temperature at the printing unit, such as for enhancing the image formation during the printing step. Alternatively, the heating step of the web may be provided at the heating zone to condition a water content of the web prior to the printing step carried out at the printing unit.

In this embodiment, the heating of the web in the heating zone by the pre heat unit is carried on during the ready-to-print step e) in the ready-to-print mode. In this way, the pre heat unit and the web is ready to be used during the print mode directly after the ready-to-print mode without delay. As a result, no time is lost between the ready-to-print mode and the print mode as the pre heat unit does not need a start up time for heating the web.

In an embodiment, the ready-to-print step e) is activated, when the ready-to-print mode continues for more than a predetermined time. In this way, the ready-to-print step e) starts after the predetermined time. In an example, when a deformation of the web due to a moist gradient in the web is determined by moist conditions of the environment, the predetermined time may be selected based on the moist conditions of the environment. On one hand, if the environment has a low humidity, the predetermined time may be set high as substantially no moist gradient will occur inside the web. On the other hand, if the environment has a high humidity, the predetermined time may be set to a certain short time as a moist gradient may easily develop inside the web at positions were the web is exposed to the environment relative to positions were the web is less exposed to the environment, such as a rolled up portion of the web at the supply roll. Additionally or alternatively, the predetermined time may be selected based on an attribute of the web, such as a moist sensitivity of the web. The attribute of the web, such as a moist sensitivity of the web, may be stored in a media library, which is accessible by a control unit of the printing system, which control unit is configured to select the predetermined time based on the attribute of the web, which is in use.

In an embodiment, the ready-to-print step e) comprises the step of jogging the print area of the web back and forth such that the web is maintained substantially stationary in the transport direction along the transport path. The jogging of the print area of the web is a repetitive movement of the web back and forth, while the web is kept substantially at the same position along the transport path. In this way, a leading edge and/or a print area of the web may be held close to the printing unit during the ready-to-print step e). The jogging step of the web may comprise a movement in a forth direction, i.e. in the transport direction, over a first jog distance and a movement in a back direction over a second jog direction, wherein the first jog distance and the second jog distance are substantially equal to one another and in opposite direction of one another. In an example, the first jog distance and the second jog distance may be selected from the range of 5 mm-50 mm. As such, a jogging movement over a relatively short distance may be sufficient to prevent or at least diminish the deformation of the web in the print area, while subjecting the print area of the web to deformation conditions, such as a pressure inside a transport pinch.

The first jog distance and the second jog distance may be selected based on an attribute of the web. The attribute of the web, such as a moist sensitivity of the web or a pressure sensitivity of the web, may be stored in a media library, which is accessible by a control unit of the printing system, which control unit is configured to select the first jog distance and the second jog distance based on the attribute of the web, which is in use.

In an embodiment, an image has been printed on an imaged area of the web prior to the ready-to-print step e) and the ready-to-print step e) comprises the step of repositioning the web along the transport path such that the imaged area of the web is positioned in a web deformation zone along the transport path. In this embodiment, the imaged area of the web is retracted along the transport path such that the imaged area of the web is positioned in a web deformation zone along the transport path. The web deformation zone may be a heating zone, a pressure zone or a zone, where the web is exposed to an environmental condition. In an example, during the ready-to-print step e) the imaged area of the web is positioned extending over a heating zone of a pre heat unit. As such, the web is only subjected to a heating condition in the heating zone at the imaged area and no deformation occurs of a print area of the web, wherein a next image is to be printed after the ready-to-print mode. The heating of the web at the imaged area does not lead to a persistent deformation of the web, as no image material is applied in the imaged area after the ready-to-print mode. In this way, a persistent deformation of the web is prevented.

It is noted that the web is not heated in the heating zone to a temperature that liquefies the image material. Further, it is noted that the image material may have been cured by suitable curing means, such as but not limited to UV radiation, which prevents that the image material may liquefy again.

In an embodiment, the imaged area of the web is moved in the transport direction beyond the print unit after the ready-to-print step e) and before the printing step c). As such, no image material is applied in the imaged area after the ready-to-print mode. In this way, a persistent deformation of the web is prevented.

In an embodiment, the method further comprises the step of i) determining an interval area arranged between a first print area and a second print area relative to the transport direction and the ready-to-print step e) comprises the step of repositioning the web along the transport path such that the interval area of the web is positioned in a web deformation zone along the transport path. An interval area is an area between a first print area and a second print area, wherein no image is formed during the printing step d) after the ready-to-print mode. The interval area may be determined in step i) by a control unit based on a print job, which print job is submitted to the printing system. In an example, before the control unit processes the print job, such as a ripping process of the image data of the print job, the control unit may determine the size of a first print area and a second print area and a size and position of an interval area between the first print area and the second print area. In the ready-to-print step e), the web is repositioned along the transport path such that the interval area of the web is positioned in a web deformation zone along the transport path. In an example, the interval area may be positioned in a transport pinch in order to subject the interval area to a pressure provided inside the transport pinch and not subject the first print area and the second print area to the pressure provided by the transport pinch during the ready-to-print step e).

In an embodiment, the transport assembly comprises a transport pinch and a second transport device for controlling a movement of the web along the transport path and the ready-to-print step e) comprises the steps of operating the second transport device to control the web located in the transport path and opening the transport pinch. In this embodiment, the second transport device controls the web during the ready-to-print step e) and the transport pinch does not control the web as it is opened, i.e. disengaged from the web. The second transport device may comprise a second transport pinch and may comprise a conveyor device having a conveyor body which is configured to support the web, wherein the conveyor body is movable to convey the web along the transport path in the printing system. The conveyer device may comprise a transport belt for supporting the web, at least one deflection roller arranged for tensioning the transport belt and an attraction means for attracting the web onto the transport belt to move the web along the transport path by a movement of the transport belt. The conveyor device may comprise a conveyor drum for supporting the web and comprise an attraction means for attracting the web onto the conveyor drum to move the web along the transport path by a movement of the conveyor drum and may comprise any other transport mechanism for controlling the position of the web along the transport path. The second transport device may hold the web by using a suction force or may hold the web by applying a pressure to the web, such as a second transport pinch controlling a web by applying a pressure. In this embodiment, the second transport pinch may be configured to apply a relatively low pressure to the web in the pinch relative to the first transport pinch.

The step of operating the second transport device may further comprise controlling a tension of the web between the supply roll and the second transport device. In this way, an orientation of the web relative to the transport path and/or a transport direction of the web along the transport path is accurately controlled.

In a further aspect, the present invention provides a method for controlling a web in a printing apparatus. The printing apparatus comprises a transport assembly for moving the web through a transport path along a printing unit for printing an image onto a print area of the web. The method comprises the steps of:

a) Feeding the web from a supply roll through the transport path to the transport assembly in the transport direction in a first operating mode (or print mode) of the printing system;

d1) Determining a termination or end of the first operating mode;

d2) if a termination is determined, switching the printing apparatus to a ready-to-print mode wherein the printing system is maintained in a state to directly commence printing;

e) wherein, in the ready-to-print mode, the transport assembly transports a print area of the web medium positioned in the deformation zone to a deformation-free zone positioned along the transport path upstream of the supply roll.

The transport path extends from the supply roll to the take-up roll. The transport assembly is provided along the transport path, for example in the form of a drive roller to step-wise move the web over the transport path. During printing, i.e. in a print mode, the transport assembly transports the web medium over the transport path along the printing unit, which swath-wise prints an image on the web. However, printing may be temporarily halted due to maintenance, supply refills, or an operator's command. However, a quick resumption of the print operation is then desired. The control unit of the printing system is configured to detect the occurrence of such an interval of temporarily halting the printing system. The control unit may derive this from signals given by the printing system or print information provided via a user interface. The control unit thus determines when the first print mode ends. The first print mode is preferably a normal operational mode or print mode of the printing system, wherein the web is conveyed in the transport direction whilst an image is deposited on said web by the printing unit. The control unit preferably acts as a scheduler which generates a schedule of the upcoming activities of the printing system, such as to be performed print jobs, maintenance, supply refills etc. This schedule can at all times be adjusted by input via the user interface, e.g. by issuing a switching command which terminates the present mode of the printing system and switches the printing system to the ready-to-print mode.

The control unit is configured to generate a switching signal at the start of a ready-to-print period. The switching signal is configured to switch the printing system to the ready-to-print mode, wherein e.g. movement of the printing unit is halted, but the heating units for e.g. ink and web media are kept activated to ensure that printing may commence rapidly. The control unit in response, when it has determined termination of the first mode and thereby the initiation of a ready-to-print interval, switches the printing system from its first or print mode to a ready-to-print mode, wherein one or more processing devices, such as heaters, remain powered on. To prevent deformation of the print area of the web medium, the control unit in the ready-to-print mode controls the transport assembly to transport the print area out of the web deformation zone, for example a pair of pinch rollers or heating plate. The control unit is configured to move the print area out of the web deformation zone and position the print area elsewhere along the transport path. Preferably, in the deformation free zone the web is unimpeded, for example engaged by only a passive supporting surface or hanging freely between transport pinches. Also, the transport assembly may, preferably continuously or repeatedly, jog the print area between the web deformation zone and the deformation free zone, such that the effective position of the print area is substantially constant over time. The deformation free zone is located along the transport path, preferably adjacent to the web deformation zone. Thereby, the print area need only be transported a short distance to prevent deformation. Preferably, the web deformation area is positioned neighboring to the deformation free zone.

In another embodiment, in the ready-to-print mode, the transport assembly transports the print area in a reverse direction opposite to the transport direction. During normal operation, i.e. during print mode, the print area is moved in the transport direction. The print area is then upstream of the printing unit, for example at the heater or transport pinch. It is the insight of the inventors that a temporary deformation of the web, by e.g. the pinch, becomes permanent when the deformed area is printed on. The printing and curing freezes the deformation into the web, making it permanently visible. However, by moving the web in the reverse direction the printed image may be positioned at the web deformation zone. It is the insight of the inventors that the deformation of the printed image is not permanent and therefore does not affect the quality of the final printed product. Alternatively, interval sections in between consecutive print areas may be positioned in the deformation zone, as deformation of said interval sections does not affect the final print product.

In another embodiment, the printing unit is positioned a predefined length along the transport path downstream of the supply roll, and the step e) further comprising the transport assembly transporting the print area in a reverse direction opposite to the transport direction over a distance less than half, preferably a third, very preferably a quarter, of the predefined length between the supply roll and the printing unit. The print area is preferably not spooled back onto the supply roll, as may be done in the sleep mode of the printing system. The print area is only moved a relatively short distance away from the web deformation zone, such that printing may be resumed quickly by moving the print area back to its original position. In one embodiment, the supply roll is maintained stationary (i.e. non-rotating) and the transport pinches provide the movement of the print area in step e).

In another embodiment, the printing system comprises a web deformation device which engages and deforms the web in the web deformation zone, wherein in the ready-to-print mode, the transport assembly transports the print area from the deformation zone to the deformation-free zone, which is positioned between the supply roll and the web deformation device.

In an embodiment, the control unit is configured to start the ready-to-print mode at the end of a print mode of the printing system. The print mode ready-to-print mode then starts adjoining the print mode. The termination of the print mode, either by expiry of the print job or by an operator command, triggers the ready-to-print period. Deformation is thereby reduced as the intermediate period between the two modes is minimized.

In another aspect of the present invention, a method is provided for controlling a web in a printing system, which printing system comprises a transport assembly for moving the web through a transport path along a printing unit for printing an image onto a print area of the web, wherein the method comprises the steps of:

a) Feeding the web from a supply roll through the transport path to the transport assembly;

b) Switching the printing apparatus to a ready-to-print mode, wherein the printing unit does not print an image on the web and the web is maintained ready to be printed on; wherein in a printing mode after the ready-to print mode the following steps are performed:

c) Moving the web through the transport path in a transport direction along the printing unit by the transport assembly; and d) Printing the image onto the print area of the web by the printing unit, wherein the image is printed by applying an image material, which solidifies on the web during the printing step; and e) Operating the transport assembly to prevent a deformation of the print area of the web in the transport path, while maintaining the web in the ready-to-print mode, by performing at least one of the following steps:

I. jogging the print area of the web back and forth such that the web is maintained substantially stationary in the transport direction along the transport path;

II. repositioning the web along the transport path such that the imaged area of the web is positioned in a web deformation zone along the transport path, after an image has been printed on an imaged area of the web; and/or III. determining an interval area arranged between a first print area and a second print area relative to the transport direction and repositioning the web along the transport path such that the interval area of the web is positioned in a web deformation zone along the transport path.

No persistent deformation of the print area of the web occurs in the ready-to-print mode of the printing system, such as pressure markings of the web in response to a pressure provided by a transport pinch over a longer period or a heating deformation of the web induced by a heating applied by a pre-heat unit to the web. In this way, a deformation of the printed image on the web is prevented, as no persistent deformation of the print area of the web occurs in the ready-to-print mode, which persists during the subsequent printing step. As such, the image material applied in the printing step after the ready-to-print mode cannot fix a deformation of the web as substantially no deformation occurs or the deformation has been so limited that the web is able to recover from the deformation before it is printed on.

The ready-to-print step e) may comprise the step I) of jogging the print area of the web back and forth such that the web is maintained substantially stationary in the transport direction along the transport path. The jogging of the print area of the web is a repetitive movement of the web back and forth, while the web is kept substantially at the same position along the transport path. In this way, a leading edge and/or a print area of the web may be held close to the printing unit during the ready-to-print step e). The jogging step of the web may comprise a movement in a forth direction, i.e. in the transport direction, over a first jog distance and a movement in a back direction over a second jog direction, wherein the first jog distance and the second jog distance are substantially equal to one another and in opposite direction of one another. A jogging movement over a relatively short distance may be sufficient to prevent or at least diminish the deformation of the web in the print area, while subjecting the print area of the web to deformation conditions, such as a pressure inside a transport pinch.

Alternatively, when an image has been printed on an imaged area of the web prior to the ready-to-print step e) and the ready-to-print step e) may comprise the step II) of repositioning the web along the transport path such that the imaged area of the web is positioned in a web deformation zone along the transport path. In this embodiment, the imaged area of the web is retracted along the transport path such that the imaged area of the web is positioned in a web deformation zone along the transport path. The web deformation zone may be a heating zone, a pressure zone or a zone, where the web is exposed to an environmental condition. In an example, during the ready-to-print step e) the imaged area of the web is positioned extending over a heating zone of a pre heat unit. As such, the web is only subjected to a heating condition in the heating zone at the imaged area and no deformation occurs of a print area of the web, wherein a next image is to be printed after the ready-to-print mode. The heating of the web at the imaged area does not lead to a persistent deformation of the web, as no image material is applied in the imaged area after the ready-to-print mode. In this way, a persistent deformation of the web is prevented.

Alternatively, the method further comprises the step of III) determining an interval area arranged between a first print area and a second print area relative to the transport direction and the ready-to-print step e) comprises the step of repositioning the web along the transport path such that the interval area of the web is positioned in a web deformation zone along the transport path. An interval area is an area between a first print area and a second print area, wherein no image is formed during the printing step c) after the ready-to-print mode. The interval area may be determined in step III) by a control unit based on a print job, which print job is submitted to the printing apparatus. In an example, before the control unit processes the print job, such as a ripping process of the image data of the print job, the control unit may determine the size of a first print area and a second print area and a size and position of an interval area between the first print area and the second print area. In the ready-to-print step e), the web is repositioned along the transport path such that the interval area of the web is positioned in a web deformation zone along the transport path. In an example, the interval area may be positioned in a transport pinch in order to subject the interval area to a pressure provided inside the transport pinch and not subject the first print area and the second print area to the pressure provided by the transport pinch during the ready-to-print step e).

In another aspect of the present invention a printing apparatus is provided, which comprises a printing unit for printing an image onto a print area of a web, a transport assembly for moving the web through a transport path along the printing unit, and a control unit configured for operating the printing unit and the transport assembly to perform the method according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 1A shows a perspective view of an exemplary embodiment of an inkjet printing assembly;

FIG. 1B shows a schematic perspective view of a scanning inkjet printing assembly as used in the printing assembly of FIG. 1A;

DETAILED DESCRIPTION OF THE DRAWINGS

Figure 2:
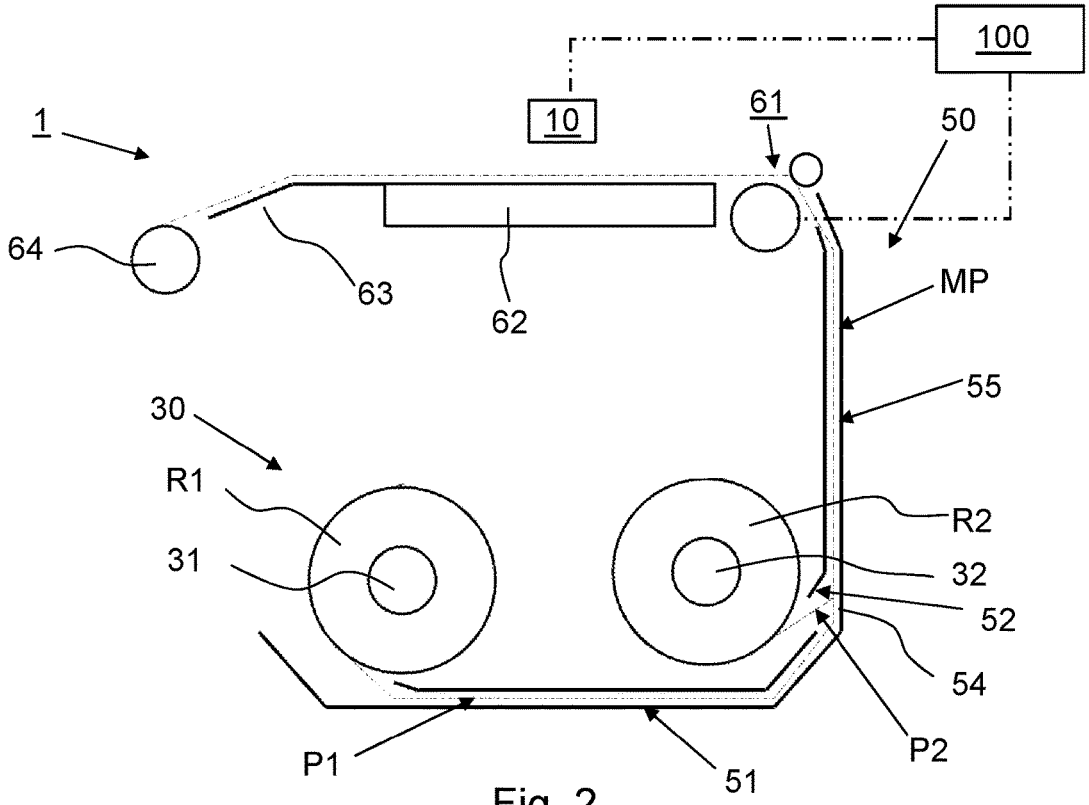
FIG. 2 shows a cross-section of another exemplary embodiment of an inkjet printing system suitable for use with the method according to the present invention.

The present invention will now be described with reference to the accompanying drawings, wherein the same reference numerals have been used to identify the same or similar elements throughout the several views.

FIG. 1A shows an image forming apparatus 1, wherein printing is achieved using a wide format inkjet printer. The wide-format image forming apparatus 1 comprises a housing 2, wherein the printing assembly, for example the ink jet printing assembly shown in FIG. 1B is placed. The image forming apparatus 1 also comprises a storage means for storing image receiving member 3, 4, a delivery station to collect the image receiving member 3, 4 after printing and storage means 5 for marking material. In FIG. 1A, the delivery station is embodied as a delivery tray 6. Optionally, the delivery station may comprise processing means for processing the image receiving member 3, 4 after printing, e.g. a folder or a puncher. The wide-format image forming apparatus 1 furthermore comprises means for receiving print jobs and optionally means for manipulating print jobs. These means may include a user interface unit 8 and/or a control unit 7, for example a computer.

Images are printed on an image receiving member, for example paper, supplied by a roll 3, 4. The roll 3 is supported on the roll support R1, while the roll 4 is supported on the roll support R2. Alternatively, cut sheet image receiving members may be used instead of rolls 3, 4 of image receiving member. Printed sheets of the image receiving member, cut off from the roll 3, 4, are deposited in the delivery tray 6.

Each one of the marking materials for use in the printing assembly are stored in four containers 5 arranged in fluid connection with the respective print heads for supplying marking material to said print heads.

The local user interface unit 8 is integrated to the print engine and may comprise a display unit and a control panel. Alternatively, the control panel may be integrated in the display unit, for example in the form of a touch-screen control panel. The local user interface unit 8 is connected to a control unit 7 placed inside the printing apparatus 1. The control unit 7, for example a computer, comprises a processor adapted to issue commands to the print engine, for example for controlling the print process. The image forming apparatus 1 may optionally be connected to a network N. The connection to the network N is diagrammatically shown in the form of a cable 9, but nevertheless, the connection could be wireless. The image forming apparatus 1 may receive printing jobs via the network. Further, optionally, the control unit of the printer may be provided with a USB port, so printing jobs may be sent to the printer via this USB port.

FIG. 1B shows an ink jet printing assembly 10. The ink jet printing assembly 10 comprises supporting means for supporting an image receiving member 3. The supporting means 11 are shown in FIG. 1B as a platen 11, but alternatively, the supporting means 11 may be a flat surface. The platen 11, as depicted in FIG. 1B, is a rotatable drum 11, which is rotatable about its axis as indicated by arrow A. The supporting means 11 may be optionally provided with suction holes for holding the image receiving member 3 in a fixed position with respect to the supporting means 11. The inkjet printing assembly 10 comprises print heads 12*a*-12*d*, mounted on a scanning print carriage 13. The scanning print carriage 13 is guided by suitable guiding means 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the image receiving member 3. The platen 11, the carriage 13 and the print heads 12*a*-12*d* are controlled by suitable controlling means 18*a*, 18*b* and 18*c*, respectively.

The image receiving member 3 may be a medium in web or in sheet form and may be composed of e.g. paper, cardboard, label stock, coated paper, plastic, canvas, film or textile. Alternatively, the image receiving member 3 may also be an intermediate member, endless or not. Examples of endless members, which may be moved cyclically, are a belt or a drum. The image receiving member 3 is moved in the sub-scanning direction A by the platen 11 along four print heads 12*a*-12*d* provided with a fluid marking material. A scanning print carriage 13 carries the four print heads 12*a*-12*d* and may be moved in reciprocation in the main scanning direction B parallel to the platen 11, such as to enable scanning of the image receiving member 3 in the main scanning direction B. Only four print heads 12*a*-12*d* are depicted for demonstrating the invention. In practice an arbitrary number of print heads may be employed. In any case, at least one print head 12*a*-12*d* per color of marking material is placed on the scanning print carriage 13. For example, for a black-and-white printer, at least one print head 12*a*-12*d*, usually containing black marking material is present. Alternatively, a black-and-white printer may comprise a white marking material, which is to be applied on a black image-receiving member 3. For a full-color printer, containing multiple colors, at least one print head 12*a*-12*d* for each of the colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guiding means 14, 15. These guiding means 14, 15 may be rods as depicted in FIG. 1B. The rods may be driven by suitable driving means (not shown). Alternatively, the carriage 13 may be guided by other guiding means, such as an arm being able to move the carriage 13. Another alternative is to move the image receiving material 3 in the main scanning direction B.

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print zone, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the image receiving member 3. Therefore, it may be advantageous to remove excess of ink from the orifice surface 16. The excess of ink may be removed for example by wiping with a wiper and/or by application of a suitable anti-wetting property of the surface, e.g. provided by a coating.

FIG. 2 illustrates schematically an image forming apparatus 1 or printing apparatus or system 1 according to the present invention. Two bearing supports 31, 32 are provided in a loading bin or tray 30 for rotatably holding a respective media roll R1, R2. From each media roll R1, R2 a respective print transport path P1, P2 extends from the media roll R1, R2 to the inkjet printing assembly 10. The print transport paths P1, P2 join together at intersection 54, after which they continue as a single main print transport path MP which extends to the inkjet printing assembly 10. The print transport paths P1, P2 and the main print transport path MP are defined by a media guide assembly 50, comprising media guide plates or conduits 51, 52, 55 for forming the respective transport paths P1, P2, MP. The main print transport MP extends further along a transport roller 61 and over a media support surface 62 or platen 62 below the inkjet printing assembly 10. The transport roller 61 is configured for driving the web provided from the respective media roll R1, R2 through the main print transport MP along the inkjet printing assembly 10. The transport device 61 may additionally comprise a pressure roller configured for urging against the transport roller 61 in a pressure zone, wherein the main print transport MP comprises the pressure zone. The transport roller and the pressure roller together form a transport pinch 61. The pressure roller enhances a control of the transport roller 61 on the movements of the web along the main print transport MP.

Downstream of the inkjet printing assembly 10 a medium 3, 4 may be guided via a guide support 63 to a take-up roller 64 for spooling the printed medium 3, 4 onto the take-up roller 64. The inkjet printing assembly 10 is configured for printing an inkjet image onto the web in a print zone located at the media support surface below the inkjet printing assembly 10.

The printing apparatus further comprises a control unit 100 for operating the inkjet printing assembly 10 for printing the inkjet image onto the web and operating the transport device 61 for controlling the web in the main print transport MP.

Figure 3A:
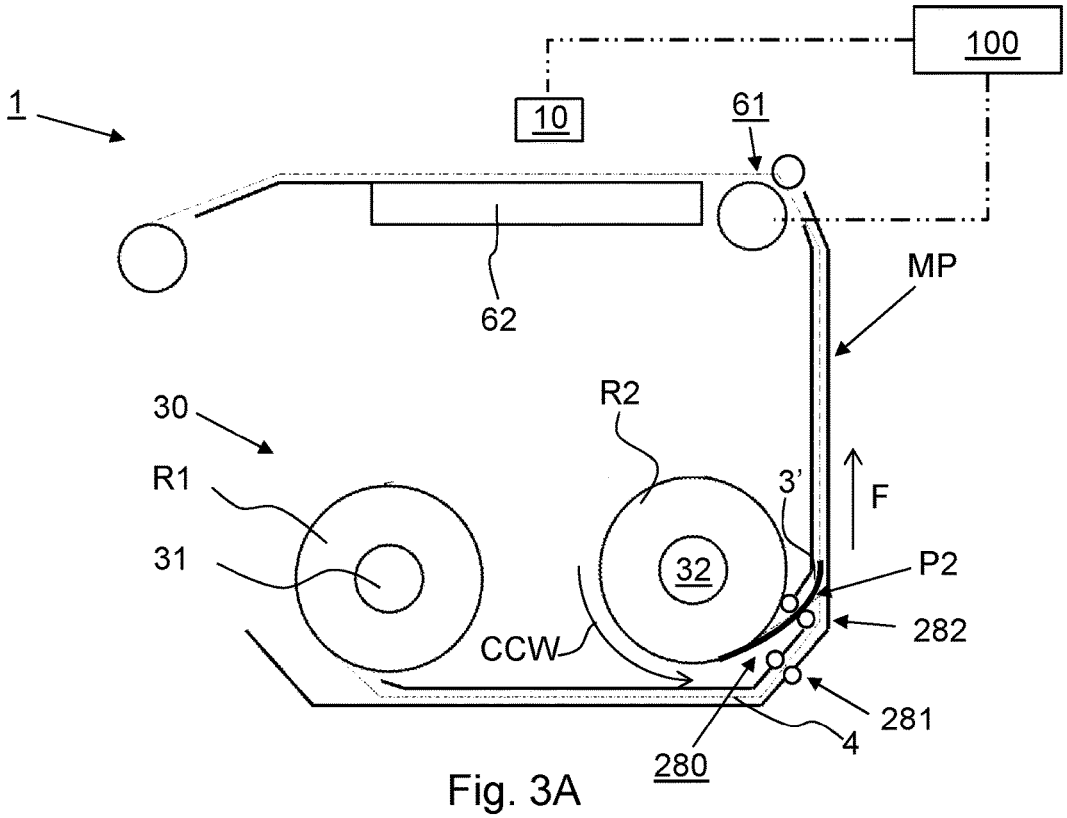
FIG. 3A-3C show cross-sections as illustrated in FIG. 2 for illustrating an embodiment of the method according to the present invention.
Figure 3B:
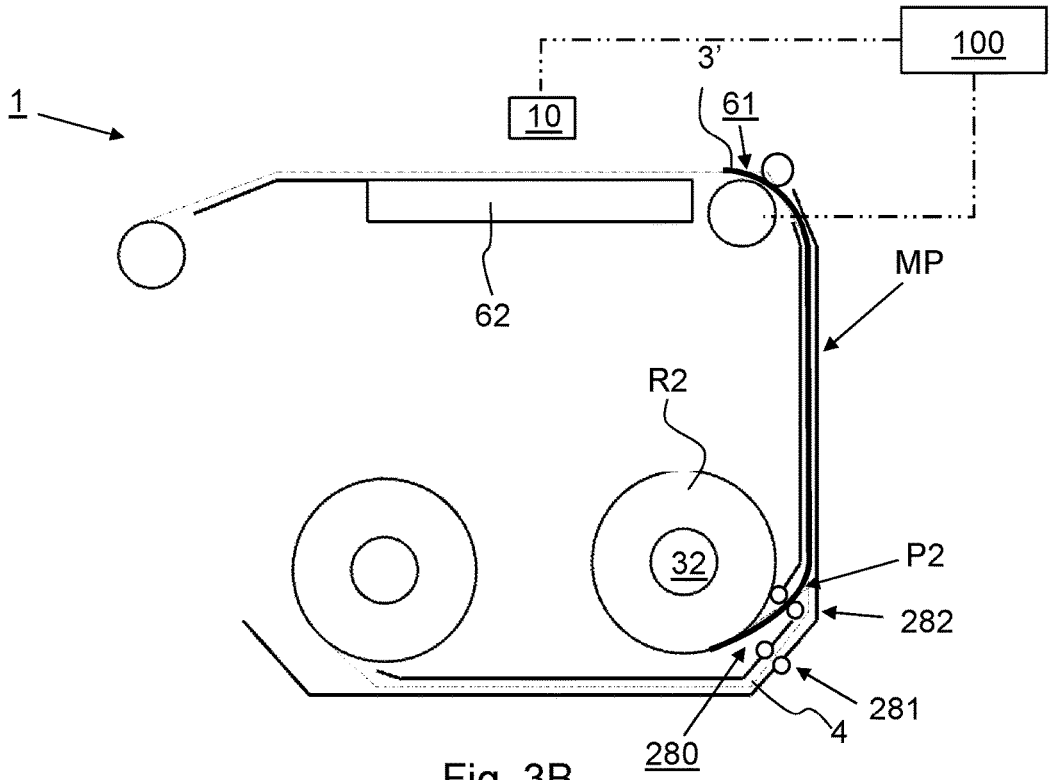
Figure 3C:
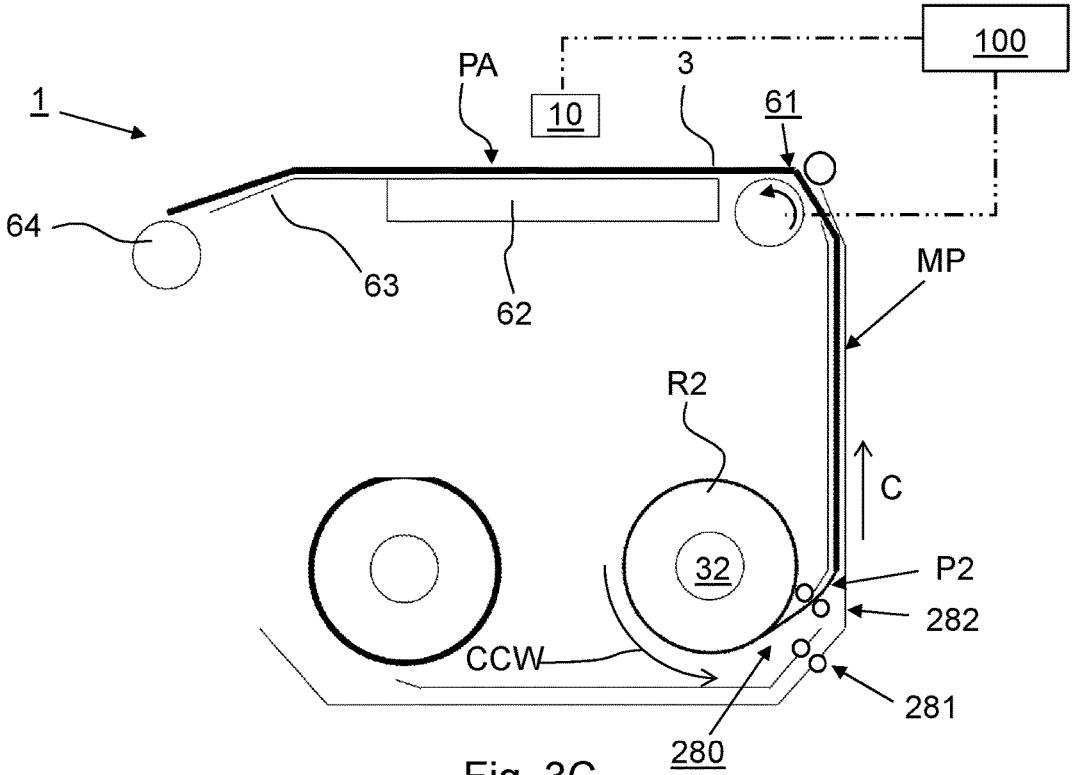

FIGS. 3A-3C are schematic side views of the printing system of FIG. 2 in various stages of the method according to the present invention.

In FIG. 3A a print medium 3 is loaded onto the media roll R2. In this example, the media roll R2 holds a relatively soft medium 3, such as a pressure sensitive vinyl banner material. Optionally another print medium 4 may be loaded onto the media roll R1. To increase production time, the print media 3, 4 are preferably fed into the printing system 1 by means of an automated web feeding system indicated by 280. Such a web feeding system 280 comprises for example pinches 281, 282 to transport the media, motors and motor control units to drive said pinches 281, 282 and media guides to guide the leading edge of a medium reliably to the print surface 62 at the inkjet printing assembly 10 without the assistance of an operator.

In this step, a leading edge portion of the print medium 3' is located in the pinch 282 in the print transport path P2. The media roll R2 is rotated counter clockwise (CCW) by driving the bearing support 32 to feed the print medium 3 in a direction F from the print transport path P2 through the main print transport MP towards the transport pinch 61.

FIG. 3B shows a second stage of the method, wherein the leading edge portion of the print medium 3' is located in the transport pinch 61 in the main print transport path MP. The second stage is a ready-to-print mode of the printing apparatus 1.

At the second stage of the method the print medium 3 is ready to be printed on in a next printing mode, which is shown in FIG. 3C. The print medium 3 is located near to the inkjet printing assembly 10 and is arranged in a predetermined orientation with respect to the main print transport path MP, i.e. having no skew relative to the main print transport path MP. In this way, the print medium 3 is ready to be printed on in a next printing mode.

Prior to the second stage of the method, the transport pinch 61 may be operated to deskew the print medium 3 relative to the main print transport path MP. For example, the transport pinch 61 may move the print medium 3 such that the print medium 3 is pulled taut between the transport pinch 61 and the media roll R2, or between the transport pinch 61 and the pinch 282, wherein the print medium 3 is allowed to slip inside the transport pinch 61. In this way, the print medium 3 is easily aligned relative to the main print transport path MP.

During the ready-to-print mode, the print medium 3 is pressurized in the transport pinch 61. When using a relatively soft medium 3, such as a pressure sensitive vinyl banner material, the print medium 3 may become deformed when subjected to pressure for a longer period.

According to an embodiment, a ready-to-print processing step is activated, when the ready-to-print mode continues for more than a predetermined time, such as more than 10 seconds or more than 1 minute. The control unit 100 determines when the predetermined time has lapsed and switches to the ready-to-print processing step.

Figure 4A:
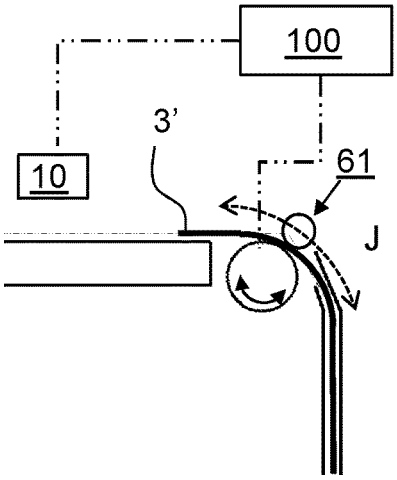
FIG. 4A-4B show cross-sections of a part of an embodiment of a printing assembly for illustrating a first and second detailed embodiment of the method according to the present invention, respectively.

An embodiment of the ready-to-print processing step is shown in FIG. 4A. FIG. 4A shows a detailed side view of the transport pinch 61 including the leading edge portion of the print medium 3', which is located in the transport pinch 61.

The drive roller of the transport pinch 61 is operated to rotate back and forth such that the print medium 3 is jogged, i.e. conveyed back and forth, along the main print transport path MP. While jogging the print medium 3, the web is maintained substantially stationary in a transport direction along the main print transport path MP. Thus, the leading edge portion of the print medium 3' remains substantially at the same position relative to the inkjet printing assembly 10.

In this way, the pressure provided by the transport pinch is only temporarily applied at a position of the print medium 3. Due to the jogging movement, a deformation of the print medium is substantially reduced. The jogging distance J over which the print medium 3 is conveyed back and forth may be in the range of 1 mm-20 cm, which may be selected dependent on the size of a deformation that is to be prevented by the jogging movement. For example, a deformation having a length in the web transport direction of about 1 cm may be prevented by jogging over a distance at least longer than the 1 cm, for example 2 cm. If the web needs more recovery time, the distance of jogging may even be further increased to, for example, 5 cm.

When a certain relatively soft medium 3, such as a pressure sensitive vinyl banner material, would be persistently deformed in the transport pinch within 10 seconds-20 seconds, a jogging transport pinch keeps the same soft medium 3 substantially undeformed for a time span of 15 minutes to 30 minutes.

During that time span, a chance is high that a new print job may be started.

FIG. 3C shows a third stage of the method, wherein a printing mode is started after the ready-to-print mode shown in FIG. 3B. In the printing mode, the print medium 3', which is located in the transport pinch 61, will be driven by the transport pinch 61 and is conveyed along the inkjet printing assembly 10 and the platen 62 in a transport direction as indicated by the arrow C. At the same time the print medium 3 is supplied from the media roll R2 by rotating the bearing support 32 counter clockwise.

At the inkjet printing assembly 10 an image PA is formed onto a print area of the print medium 3. The image PA may, for example, be formed by applying a phase change ink in the form of ink droplet. The ink droplets are ejected by the inkjet printing assembly 10 at a temperature higher than room temperature. The ink droplets are cooled by the platen 62, when deposited on the print medium 3. In response to a cooling down to room temperature, the image on the print medium 3 is solidified. The print medium 3 including the solidified image is moved along the guide support 63 and is received on the take-up roller 63 by winding the print medium 3 onto the take-up roller 63.

The print medium 3 is substantially undeformed at the time of printing the image PA onto the print medium 3. As a result, the image including the print medium 3 is not deformed after printing, even when the image material (phase change ink) solidifies on the print medium 3.

When the ready-to-print mode and the ready-to-print processing step continues for more than a critical time, such as 30 minutes, the printing apparatus 1 may switch to a sleep mode (not shown), wherein the print medium 3 is retracted from the main print transport path MP and rewound on the media roll R2. However, in the sleep mode the transport pinch 61 does not control the print medium 3 and the print medium 3 is not ready to be printed on.

Figure 4B:
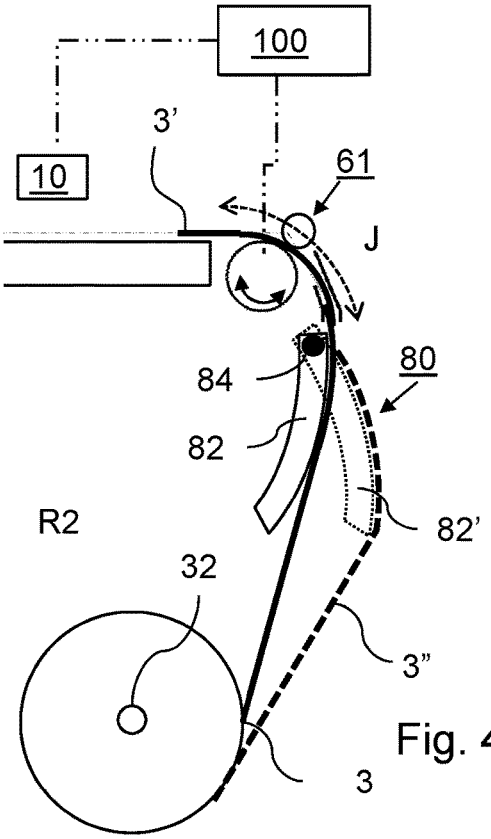

FIG. 4B shows an alternative embodiment of the ready-to-print processing step used for the ready-to-print mode, such as shown in FIG. 3B. FIG. 4B shows a detailed side view of the transport pinch 61 including the leading edge portion of the print medium 3', which is located in the transport pinch 61.

In the printing apparatus of this embodiment, a guidance assembly 80 is arranged facing the main print transport path MP between the media roll R2 and the transport pinch 61. The guidance assembly 80 comprises a guidance plate 82 extending along the main print transport path MP, which guidance plate 82 is pivotably supported at one of its ends by a supporting axle 84. The guidance plate 82 is urged towards the print medium 3 located in the print transport path MP.

When the transport pinch 61 is operated to perform a jogging movement J of the print medium 3 along the print transport path MP, the guidance plate rotates back and forth about the supporting axle 84 thereby compensating any length differences of the print medium 3 between the transport pinch 61 and the media roll R2. An outer position of the guidance plate 82' including the print medium 3" is indicated by dashed lines, in which outer position the longer length of the print medium 3" between the transport pinch 61 and the media roll R2 is accommodated by a longer length of the print transport path MP. In this way, a tension is maintained in print medium 3 between the transport pinch 61 and the media roll R2 despite the jogging movement J of the print medium 3 at the transport pinch 61. As the tension is maintained in the ready-to-print processing step, the position of the print medium 3 is accurately controlled during the ready-to-print processing step.

Figure 5:
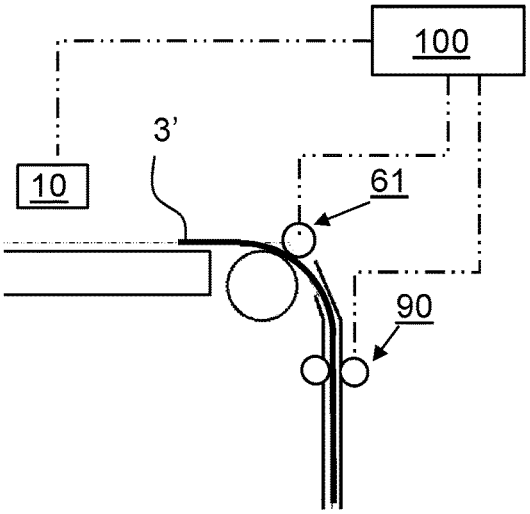
FIG. 5 shows a cross-section of a part of an embodiment of a printing assembly for illustrating a third detailed embodiment of the method according to the present invention.

FIG. 5 shows an alternative embodiment of the ready-to-print processing step used for the ready-to-print mode, such as shown in FIG. 3B. FIG. 5 shows a detailed side view of the transport pinch 61 including the leading edge portion of the print medium 3', which is located in the transport pinch 61.

In the printing apparatus of this embodiment, a second medium pinch 90 is arranged at the main print transport path MP between the media roll R2 and the transport pinch 61. The second medium pinch 90 is controlled by the control unit 100. The second medium pinch 90 may comprise two rollers arranged opposite one another for holding the print medium 3 at the main print transport path MP. The second medium pinch 90 may be controlled by the control unit 100 to engage the print medium 3 in a closed state or disengage the print medium 3 in an open state.

In the ready-to-print processing step the second medium pinch 90 may be arranged in the closed state to retain the print medium 3 stationary in the main print transport path MP and to maintain a tension constant between the second medium pinch 90 and the media roll R2.

Subsequently the transport pinch 61 may be opened by the control unit 100 to disengage the print medium 3 at the transport pinch 61. In this way, during the ready-to-print processing step no pressure is provided to the print medium 3 at the transport pinch 61. The pressure at the second medium pinch 90 may be minimized by using soft material as roller components or may be minimized by applying a low pinch force between the two rollers. The second medium pinch 90 may not be provided to drive the print medium 3 along the main print transport path MP, thus a low pressure may be sufficient to retain the print medium 3.

Alternatively the second medium pinch 3 may be provided by a first plate and an opposing second plate (not shown), which are controlled by the control unit 100 to be arranged in a closed state to retain the print medium 3 or in an open state. Both plates extend along the main print transport path MP, and may additionally be provided by a high friction surface, to provide a friction force to the print medium 3, while employing a relatively low pressure to the print medium 3. In this way, the print medium 3 is maintained stationary in the main print transport path MP without deforming the print medium 3.

When switching to a printing mode, as shown in FIG. 3C, the transport pinch 61 may be closed to engage the print medium 3, may additionally be driven to control the tension of the print medium 3 between the transport pinch 61 and the second medium pinch 90, and the second medium pinch 90 may be opened to release the print medium 3. Thereafter the printing mode, as shown in FIG. 3C, may start. The print medium 3 is substantially not deformed during the ready-to-print processing step used for the ready-to-print mode.

FIGS. 6A-6D are schematic side views of a modified printing system 1 in various stages of the method according to the present invention. The printing system 1 further comprises a heating plate 70 arranged facing the main print transport path MP between the transport pinch 61 and the two bearing supports 31, 32 which are provided in the loading bin or tray 30. The heating plate 70 is controlled by the control unit 100 and is arranged for heating the print medium 3 located in the main print transport path MP at a heating zone 72.

Figure 6A:
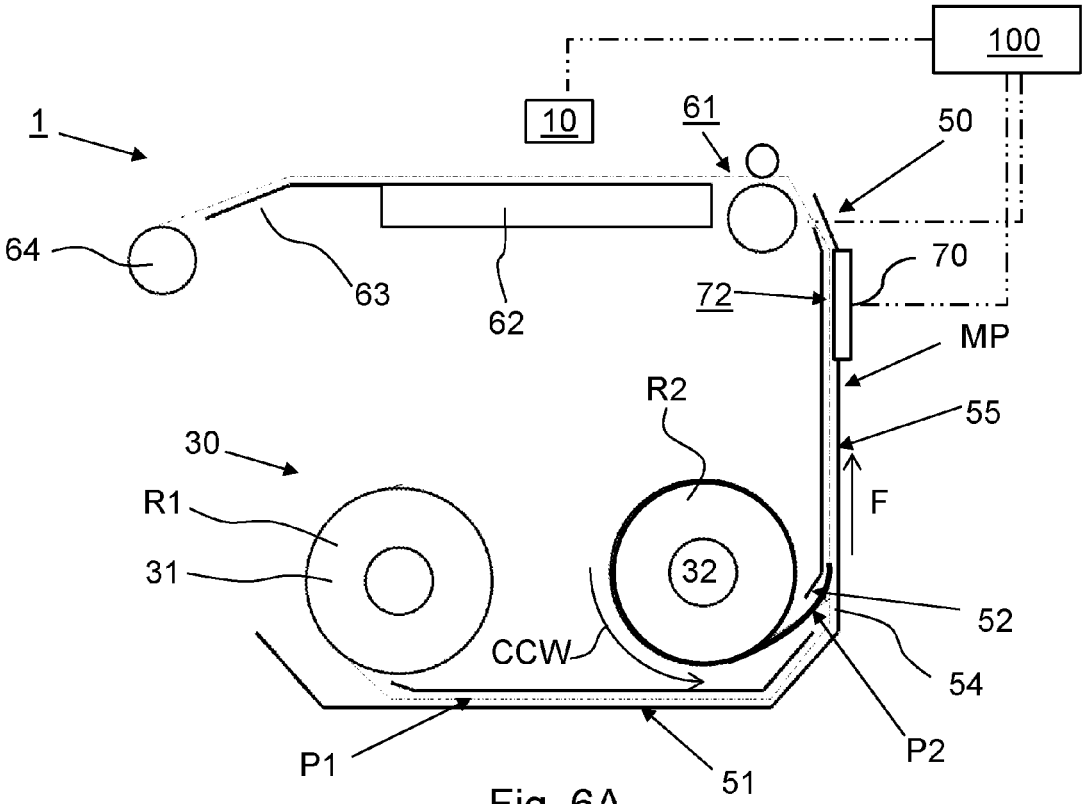
FIG. 6A-6D show cross-sections of a part of an embodiment of a printing assembly for illustrating a fourth detailed embodiment of the method according to the present invention.

In FIG. 6A a print medium 3 is loaded onto the media roll R2. In this example, the media roll R2 holds a medium 3, such as a paper like material. Optionally another print medium 4 may be loaded onto the media roll R1.

To increase production time, the print media 3, 4 are preferably fed into the printing system 1 by means of an automated web feeding system indicated by 280, as shown in FIGS. 3A-3C. Such a web feeding system 280 comprises for example pinches 281, 282 to transport the media, motors and motor control units to drive said pinches 281, 282 and media guides to guide the leading edge of a medium reliably to the print surface 62 at the inkjet printing assembly 10 without the assistance of an operator.

In this step, a leading edge portion of the print medium 3' is located in the print transport path P2. The media roll R2 is rotated counter clockwise by driving the bearing support 32 to feed the print medium 3 in a direction F from the print transport path P2 through the main print transport MP towards the transport pinch 61. The print medium 3 is heated to a predetermined temperature in the heat zone 72 by the heating plate 70. Subsequently the print medium 3 is engaged by the transport pinch 61.

Figure 6B:
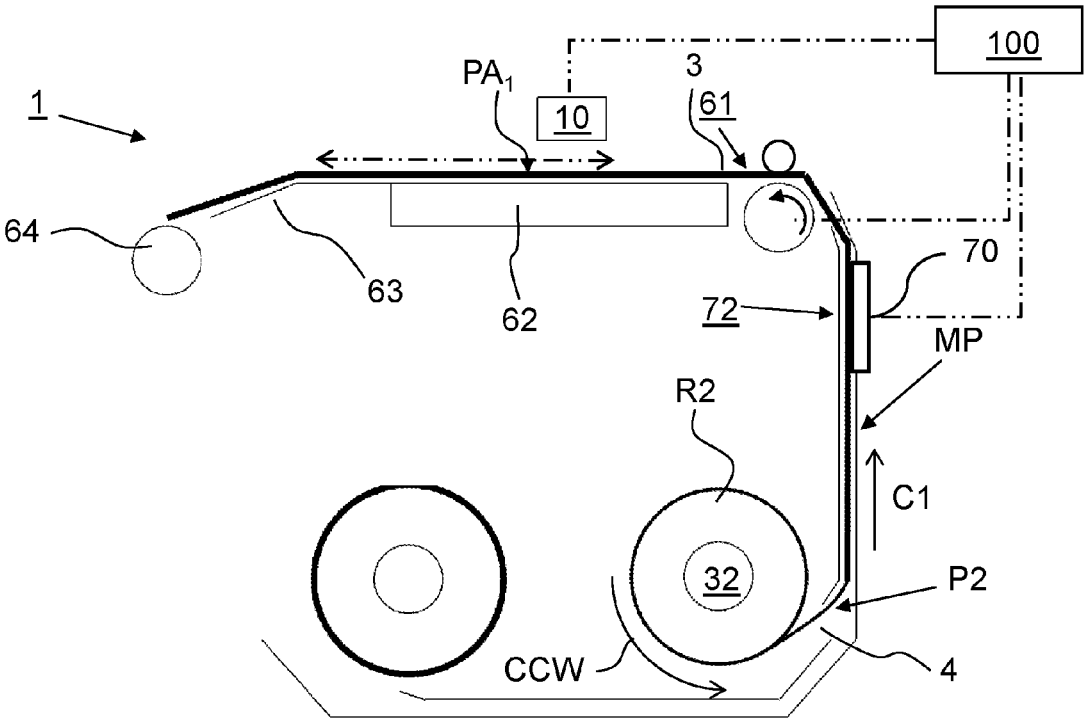

FIG. 6B shows a second stage of the method, wherein the leading edge portion of the print medium 3' is moved beyond the inkjet printing assembly 10. The transport pinch 61 drives the print medium 3 to convey in a transport direction C1 along the inkjet printing assembly 10. The media roll R2 supplies the print medium 3 from the print transport path P2 into the main print transport path MP by rotating the bearing support 32 counter clockwise.

The inkjet printing assembly 10 is controlled by the control unit 100 to print an image PA1 onto the print media 3 in an imaged area as indicated by dashed arrow. The image solidifies on the web during the printing process, such as by cooling down the image. The print medium 3 is pre-heated upstream of the printing zone at the inkjet printing assembly 10 in the heating zone 72 by the heating plate 70.

Figure 6C:
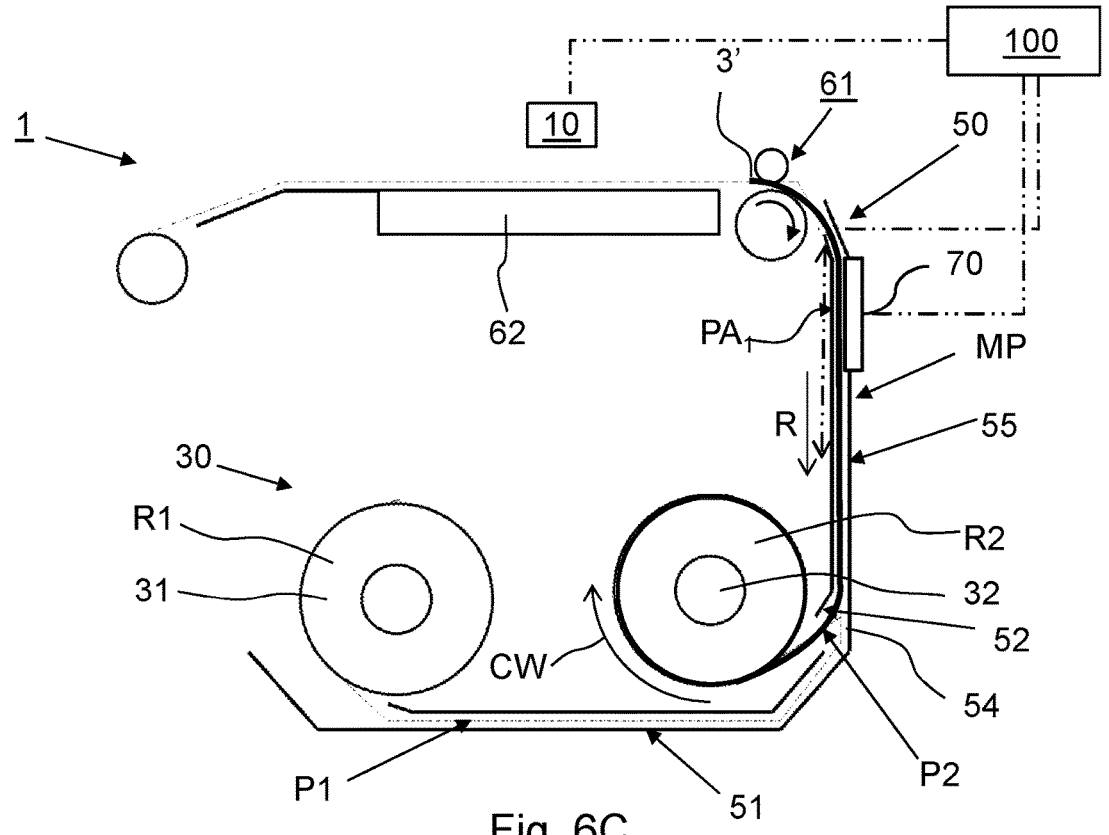

FIG. 6C shows a third stage of the method, which is a ready-to-print mode of the printing apparatus 1.

The third stage of the method is after the printing step shown in FIG. 6B, wherein the print media 3 is moved backwards by the transport pinch 61 as indicated by arrow R.

During the third stage of the method no image is printed onto the print medium 3. The print media 3 is repositioned such that the printed image $PA_1$ in the imaged area is located at the heating zone 72 of the heating plate 70. The media roll is rotated clockwise to rewind a portion of the print medium 3. A leading edge portion of the print medium 3' is located close to the inkjet printing assembly 10 and is controlled by the transport pinch 61. When the printed image $PA_1$ in the imaged area is located at the heating zone 72 of the heating plate 70, the print medium 3 is in the ready-to-print mode. The printed image $PA_1$ in the imaged area is heated, since the heating plate is kept at an elevated temperature in the ready-to-print mode to prevent the necessity for warming-up before printing.

Figure 7:
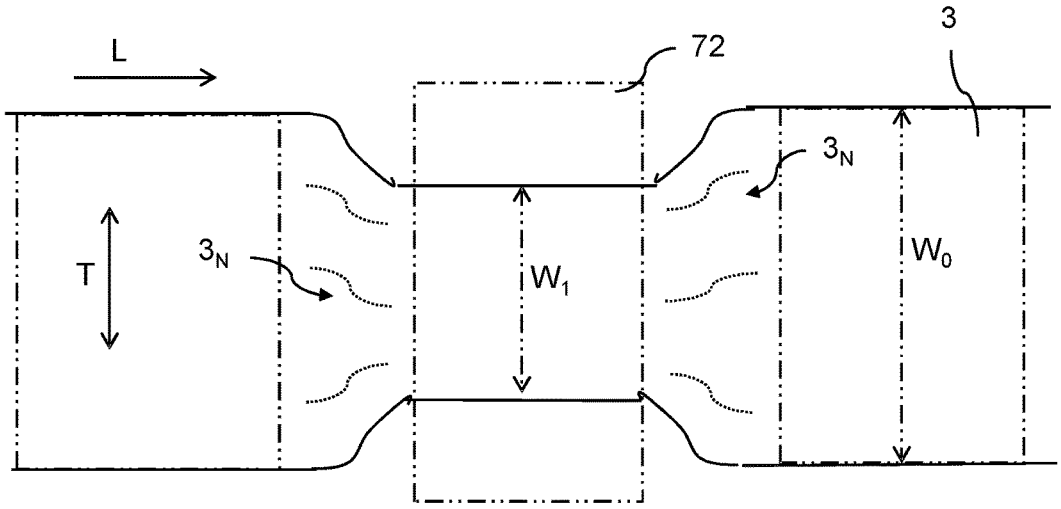
FIG. 7 shows top view of a web for illustrating an example of a deformation.

For example, as shown in FIG. 7, by heating a paper like material 3 in an unprinted area, said paper like material 3 may shrink to a shortened width W1 relative to an original width W0 due to evaporation of water from the paper like material 3 at the heating zone 72. Due to the evaporation of water in the paper like material 3 at the heating zone a moisture gradient exists between the heating zone 72 and neighboring areas of the paper like material $3_N$ in a longitudinal direction L of the main print transport path MP. This will lead to out of plane deformations of the paper like material $3_N$, especially on places were an expansion or a retraction of the paper like material 3 in the transversal direction T is prohibited by pinches or friction. These media deformations can also lead to the paper like material 3 touching the inkjet printing assembly 10, e.g. printheads, when moving said deformed part of the paper like material 3 along the inkjet printing assembly 10 afterwards.

When an imaged area PA1 of the paper like material 3 is positioned in the heating zone 72, the paper like material 3 may still deform as evaporation of water from the paper like material 3 still occurs in the imaged area PA1. However, such a deformation is not persistent as said deformation is not fixed onto the web afterwards by printing and solidification of ink, while the web is deformed. The imaged area PA1 has been printed on previously and the ink has solidified in an undeformed state of the web. When the deformed imaged area PA1 recovers from the deformed state due to moisturizing under room conditions, the image material will also recover to the original, flat, undeformed state.

It is noted that the web is not heated to a temperature that liquefies the image material. Further, it is noted that the image material may have been cured by suitable curing means, such as but not limited to UV radiation, which prevents that the image material may liquefy again.

Even further, it is noted that the presence of the image material may suppress any deformation of the web e.g. due to a moisture gradient in the web as described in relation to FIG. 7.

Figure 6D:
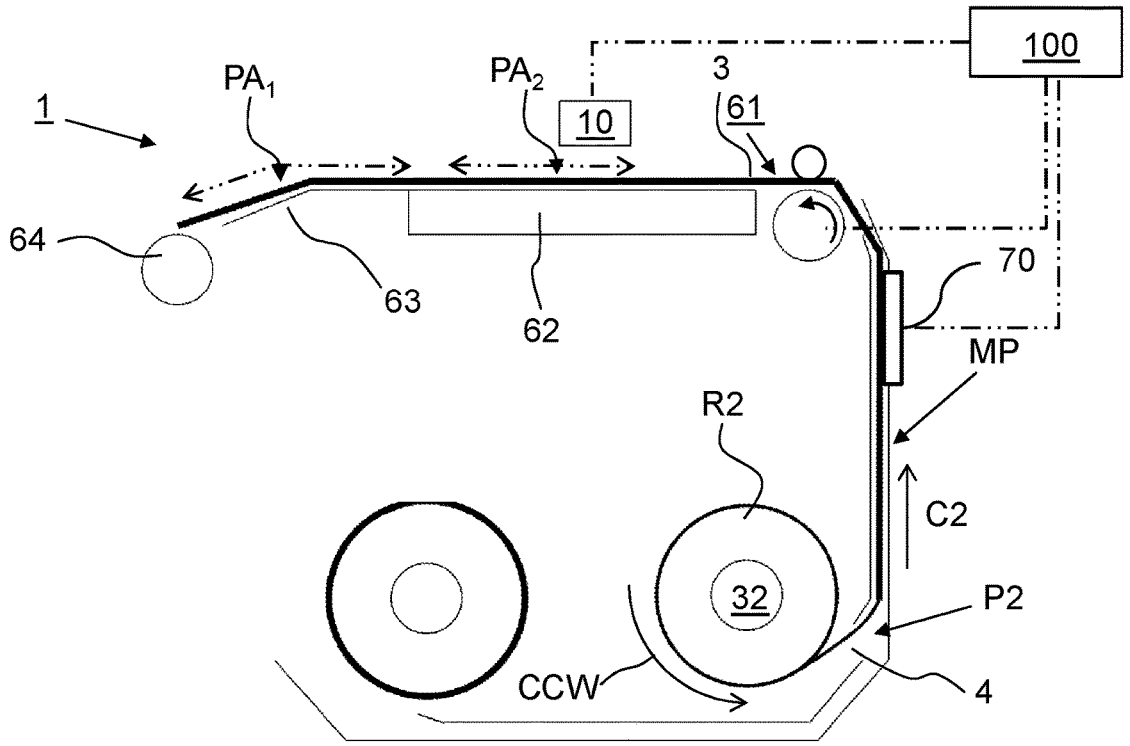

FIG. 6D shows a fourth stage of the method, which is a printing mode started right after the ready-to-print mode of the printing apparatus 1. During the fourth stage, the transport pinch 61 conveys the print media 3 including the imaged area PA1 along the inkjet printing assembly 10 in a direction C1, while the inkjet printing assembly 10 is not printing. The printing media 3 is fed from the media roll R2 by rotating the bearing support 32 counter clockwise. The inkjet printing assembly starts printing a second image on a print area PA2 behind the imaged area PA1 with respect to the transport direction C1. The second image in said print area PA2 is printed on a part of the print media 3, which is not deformed during the ready-to-print mode shown in FIG. 6C. Additionally or alternatively to the ready-to-print step described in reference to FIG. 6C, the transport pinch 61 may be operated to move the print media 3 in a jogging movement, i.e. back and forth as shown in FIG. 4A, along the heating zone 72 in the media print transport path MP in the ready-to-print mode. For example, the imaged area PA1 may be moved in a jogging movement along the heating zone 72. In another example, a print area of the print medium 3, which is not imaged, may be moved in a jogging movement along the heating zone 72.

In this way a moisture gradient of the print media 3 along the media print transport path MP is reduced. As a result, the deformation of the print media 3 at the heating zone 72 is reduced.

Figure 8:
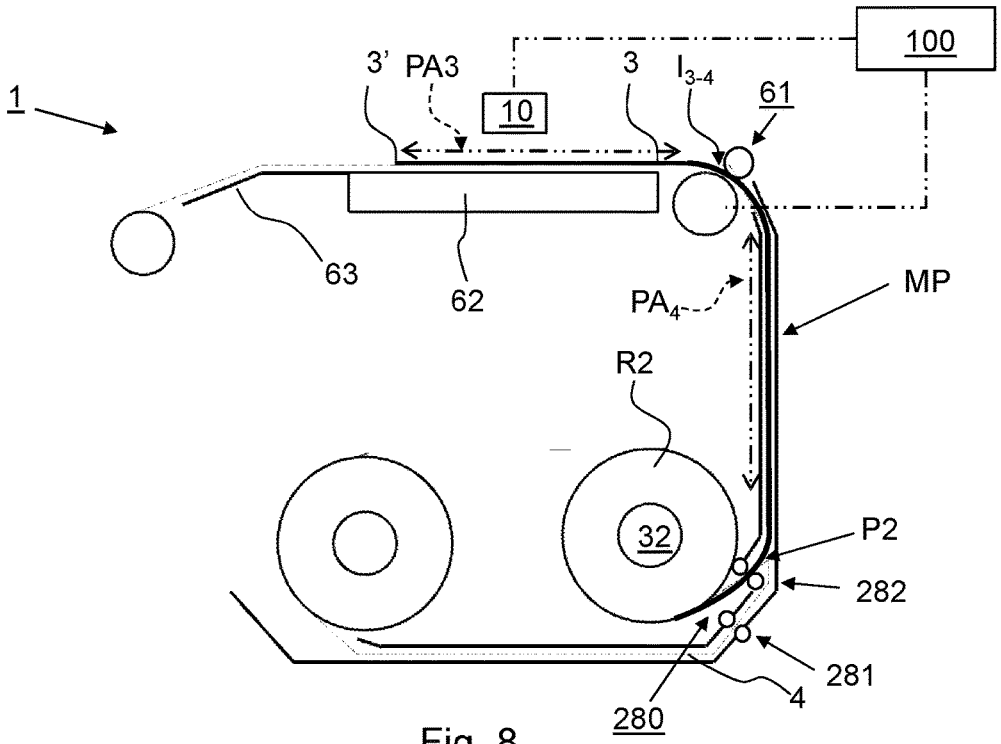
FIG. 8 shows a cross-section of a part of an embodiment of a printing assembly for illustrating a fifth detailed embodiment of the method according to the present invention.

FIG. 8 shows an alternative embodiment of the ready-to-print processing step used for the ready-to-print mode of the printing apparatus as shown in FIG. 3B.

In the ready-to-print mode the leading edge part of the print medium 3' is fed towards the transport pinch 61 to be engaged by the transport pinch 61.

The control unit 100 is configured to determine a first print area PA3 close to the leading edge part of the print medium 3', is further configured to determine a second print area PA4 upstream of the first print area PA3 and an interval area $I_{3-4}$ arranged in between the second print area PA4 and the first print area PA3. For example the second print area PA4 and the first print area PA3 and the interval area $I_{3-4}$ are derived from a print job, which is processed by the control unit 100, such as a ripping process of the images to be printed after the ready-to-print mode. Optionally, the control unit 100 may be configured to determine a first print area PA3 close to the leading edge part of the print medium 3' and an interval area $I_{3-4}$ without determining the size of the second print area PA4.

In this embodiment of the ready-to-print processing step, the control unit 100 controls the transport pinch 61 to reposition the print medium 3, such that the interval area $I_{3-4}$ is located at the transport pinch 61. The first print area PA3 is located downstream of the transport pinch 61, i.e. at the platen 62, and the second print area PA4 is located upstream of the transport pinch 61 in the main print transport path MP.

In this way, only the interval area $I_{3-4}$ is deformed by the transport pinch 61 during the ready-to-print mode.

After the ready to print mode, the leading edge part of the print medium 3' is moved backwards to the start of the inkjet printing assembly 10, the first image is printed in the first print area PA3 and the second image is printed in the second print area PA4, while moving the print medium 3 in the transport direction along the inkjet printing assembly 10. Both print areas PA3, PA4 were not deformed during the ready-to-print mode. As a result no deformation of the print medium 3 is fixed by application of the image material on the print medium, none withstanding the solidification of the image by the image material during the printing step on the print medium 3.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for controlling a web in a printing apparatus, wherein the printing apparatus comprises a transport assembly for transporting the web over a transport path extending downstream of a supply roll and along a printing unit, said transport path comprising a web deformation zone between the roll supply and the printing unit, the method comprising the steps of:

a) feeding the web from the supply roll through the transport path to the transport assembly in a transport direction;

b) moving the web with the transport assembly through the transport path in the transport direction along the printing unit in a print mode of the printing apparatus;

c) printing an image onto a print area of the web with the printing unit in the print mode, wherein the image is printed by applying an image material, which solidifies on the web during the printing step;

d1) determining a termination of the print mode of the printing apparatus;

d2) upon determination of the termination of the print mode, switching the printing apparatus to a ready-to-print mode, wherein the printing apparatus is maintained in a state to directly commence printing; and e) in the ready-to-print mode, the transport assembly transporting the print area of the web medium positioned in the deformation zone to a deformation-free zone positioned along the transport path upstream of the supply roll, wherein the ready-to-print step e) comprises a step of jogging the print area of the web back and forth such that the web is maintained substantially stationary in the transport direction along the transport path.

2. The method according to claim 1, wherein in the ready-to-print mode, the transport assembly in step e) transports the print area in a reverse direction opposite to the transport direction.

3. The method according to claim 2, wherein the printing apparatus comprises a web deformation device which engages and deforms the web in the web deformation zone, wherein in the ready-to-print mode, the transport assembly in step e) transports the print area from the deformation zone to the deformation-free zone, which deformation-free zone is positioned between the supply roll and the web deformation device.

4. The method according to claim 1, wherein the printing unit is positioned a predefined length along the transport path downstream of the supply roll, and the step e) further comprises the transport assembly transporting the print area in a reverse direction opposite to the transport direction over a distance less than half of the predefined length between the supply roll and the printing unit.

5. The method according to claim 1, wherein the method comprises the steps of:

a) feeding the web from a supply roll through the transport path to the transport assembly; and d) switching the printing apparatus to a ready-to-print mode, wherein the printing unit does not print an image on the web and the web is maintained ready to be printed on, wherein in a printing mode after the ready-to print mode the following steps are performed:

b) moving the web through the transport path in the transport direction along the printing unit by the transport assembly; and c) printing the image onto the print area of the web by the printing unit, wherein the image is printed by applying an image material, which solidifies on the web during the printing step, and wherein the ready-to-print mode comprises the step of:

e) operating the transport assembly to prevent a deformation of the print area of the web in the transport path, while maintaining the web in the ready-to-print mode.

6. The method according to claim 5, wherein in the printing step c) the image is printed by an inkjet printing unit comprising ejecting droplets of image material to form the image on the web.

7. The method according to claim 5, wherein the method after the printing step c) further comprises the steps of f) retracting the web from the transport path and g) switching the printing apparatus to a sleep mode, wherein the web is not controlled by the transport assembly.

8. The method according to claim 1, wherein the image material applied in step c) comprises a phase change component, which solidifies the image when cooled to room temperature.

9. The method according to claim 1, wherein the image material applied in step c) comprises a radiation curable component, which solidifies the image in response to a curing radiation, and wherein the printing step c) further comprises applying the curing radiation to the image material on the web.

10. The method according to claim 1, wherein the method further comprises the step of h) operating the transport assembly to deskew at least a part of the web relative to the transport path prior to the switching step d) such that the web during the ready-to-print step e) is in a predetermined orientation with respect to the transport path.

11. The method according to claim 1, wherein the transport assembly comprises a transport pinch comprising a drive roller for driving the web along the transport path and a pressure roller configured for urging against the drive roller in a pressure zone during the moving step b).

12. The method according to claim 1, wherein the printing apparatus further comprises a pre-heat unit configured for heating the web in a heating zone during the ready-to-print step e) and during the printing step c); the transport path comprising the heating zone.

13. The method according to claim 1, wherein the ready-to-print step e) is activated, when the ready-to-print mode continues for more than a predetermined time.

14. The method according to claim 1, wherein an image has been printed on an imaged area of the web prior to the ready-to-print step e) and the ready-to-print step e) comprises the step of repositioning the web along the transport path such that the imaged area of the web is positioned in the web deformation zone along the transport path.

15. The method according to claim 14, wherein the imaged area of the web is moved in the transport direction beyond the print unit after the ready-to-print step e) and before the subsequent printing step c).

16. The method according to claim 1, wherein the transport assembly comprises a transport pinch and a second transport device for controlling a movement of the web along the transport path and the ready-to-print step e) comprises the steps of operating the second transport device to control the web located in the transport path and opening the transport pinch.

17. A printing apparatus, comprising:

a printing unit for printing an image onto a print area of a web;

a transport assembly for moving the web through a transport path along the printing unit; and a control unit configured for operating the printing unit and the transport assembly to perform the method according to claim 1.

18. A method for controlling a web in a printing apparatus, wherein the printing apparatus comprises a transport assembly for transporting the web over a transport path extending downstream of a supply roll and along a printing unit, said transport path comprising a web deformation zone between the roll supply and the printing unit, the method comprising the steps of:

a) feeding the web from the supply roll through the transport path to the transport assembly in a transport direction;

b) moving the web with the transport assembly through the transport path in the transport direction along the printing unit in a print mode of the printing apparatus;

c) printing an image onto a print area of the web with the printing unit in the print mode, wherein the image is printed by applying an image material, which solidifies on the web during the printing step;

d1) determining a termination of the print mode of the printing apparatus;

d2) upon determination of the termination of the print mode, switching the printing apparatus to a ready-to-print mode, wherein the printing apparatus is maintained in a state to directly commence printing; and e) in the ready-to-print mode, the transport assembly transporting the print area of the web medium positioned in the deformation zone to a deformation-free zone positioned along the transport path upstream of the supply roll, wherein the method further comprises the step of determining an interval area arranged between a first print area and a second print area relative to the transport direction and the ready-to-print step e) comprises the step of repositioning the web along the transport path such that the interval area of the web is positioned in the web deformation zone along the transport path.

19. A method for controlling a web in a printing apparatus, wherein the printing apparatus comprises a transport assembly for transporting the web over a transport path extending downstream of a supply roll and along a printing unit, said transport path comprising a web deformation zone between the roll supply and the printing unit, the method comprising the steps of:

a) feeding the web from the supply roll through the transport path to the transport assembly in a transport direction;

b) moving the web with the transport assembly through the transport path in the transport direction along the printing unit in a print mode of the printing apparatus;

c) printing an image onto a print area of the web with the printing unit in the print mode, wherein the image is printed by applying an image material, which solidifies on the web during the printing step;

d1) determining a termination of the print mode of the printing apparatus;

d2) upon determination of the termination of the print mode, switching the printing apparatus to a ready-to-print mode, wherein the printing apparatus is maintained in a state to directly commence printing; and e) in the ready-to-print mode, the transport assembly transporting the print area of the web medium positioned in the deformation zone to a deformation-free zone positioned along the transport path upstream of the supply roll, wherein an image has been printed on an imaged area of the web prior to the ready-to-print step e) and the ready-to-print step e) comprises the step of repositioning the web along the transport path such that the imaged area of the web is positioned in the web deformation zone along the transport path.

* * * * *